US008389884B2

(12) United States Patent
Gelloz et al.

(10) Patent No.: US 8,389,884 B2
(45) Date of Patent: Mar. 5, 2013

(54) ELECTRICAL SWITCH APPARATUS HAVING TWO INTERRUPTERS, SUCH AS A BUSBAR DISCONNECTOR AND A GROUNDING DISCONNECTOR, AND INCLUDING COMMON ACTUATOR MEANS FOR THE MOVABLE CONTACTS OF THE INTERRUPTERS

(75) Inventors: Bernard Gelloz, Saint Offenge Dessous (FR); Christophe Rech, Grezy sur Aix (FR)

(73) Assignee: Areva T & D SAS, Paris (FR)

( * ) Notice: Subject to any disclaimer, the term of this patent is extended or adjusted under 35 U.S.C. 154(b) by 539 days.

(21) Appl. No.: 12/577,059

(22) Filed: Oct. 9, 2009

(65) Prior Publication Data

US 2010/0089732 A1 Apr. 15, 2010

(30) Foreign Application Priority Data

Oct. 14, 2008 (FR) ..... 08 56952

(51) Int. Cl.
*H01H 3/04* (2006.01)
*H01H 3/20* (2006.01)

(52) U.S. Cl. ..... 200/335; 218/154

(58) Field of Classification Search ..... 200/335, 200/50.24

See application file for complete search history.

(56) References Cited

U.S. PATENT DOCUMENTS

| | | | | |
|---|---|---|---|---|
| 5,569,891 | A * | 10/1996 | Freeman et al. | 200/17 R |
| 6,437,269 | B1 | 8/2002 | Rakus | |
| 6,545,241 | B1 | 4/2003 | Franchi et al. | |
| 6,603,087 | B2 | 8/2003 | Osterholm et al. | |
| 7,692,113 | B2 | 4/2010 | Meinherz | |

FOREIGN PATENT DOCUMENTS

| | | | |
|---|---|---|---|
| CH | 696476 | A5 | 6/2007 |
| DE | 19602912 | A1 | 7/1997 |
| DE | 10205334 | C1 | 11/2003 |
| EP | 0735637 | A2 | 10/1996 |
| EP | 1082791 | B1 | 4/2005 |
| FR | 2744284 | A1 | 8/1997 |
| WO | 0024099 | A1 | 4/2000 |

OTHER PUBLICATIONS

Office Action issued for U.S. Appl. No. 12/576,723, dated Oct. 21, 2011.
French Search Report, FR 0856952, dated May 13, 2009.
French Search Report, FR 0856946, dated May 13, 2009.
U.S. Appl. No. 12/576,723, filed Oct. 9, 2009.

* cited by examiner

*Primary Examiner* — Renee S Luebke
*Assistant Examiner* — Lheiren Mae Caroc
(74) *Attorney, Agent, or Firm* — Nixon Peabody LLP

(57) ABSTRACT

A switch apparatus comprising two interrupters, such as a busbar disconnector and a grounding disconnector. Common actuator means are provided for the movable contacts of the interrupters, for permitting one of the interrupters to be opened while holding the other interrupter closed, and vice versa, which enables the strokes performed by the movable contacts to be crossed.

24 Claims, 5 Drawing Sheets

Coupe A-A

Coupe B-B

ELECTRICAL SWITCH APPARATUS HAVING TWO INTERRUPTERS, SUCH AS A BUSBAR DISCONNECTOR AND A GROUNDING DISCONNECTOR, AND INCLUDING COMMON ACTUATOR MEANS FOR THE MOVABLE CONTACTS OF THE INTERRUPTERS

CROSS REFERENCE TO RELATED APPLICATIONS OR PRIORITY CLAIM

This application claims priority of French Patent Application No. 08 56952, filed Oct. 14, 2008.

TECHNICAL FIELD

This invention relates in general terms to the field of high or medium voltage switch apparatus having two interrupters, such as a busbar disconnector and a grounding disconnector.

In particular, the invention relates to those kinds of switch apparatus in which one of the interrupters is a busbar disconnector and the other interrupter is a grounding disconnector.

More specifically, the invention relates to that type of switch apparatus in which each interrupter, for example a disconnector, has a pair of contacts that consist of a stationary contact and a contact that is movable in straight line movement so as to separate the contacts from each other in a switching operation.

The main application is to medium or high voltages in which the busbar disconnector and grounding disconnector are disposed in insulated switch casings, each of which is filled with a dielectric gas under controlled atmospheric conditions, for example $SF_6$.

PRIOR ART

The mechanical operations performed in this type of apparatus are commonly independent, being carried out by two separate mechanical control units that are controlled by mechanical or electrical interlocking devices.

These interlocking devices, the purpose of which is to ensure the safety of personnel and equipment, operate by permitting the position of the busbar disconnector to be held open while the grounding disconnector is in its closed state, since the grounding disconnector must not be closed when there is a voltage on the main circuit.

It has in the past been proposed to actuate each movable contact of two separate interrupters, such as a busbar disconnector and a grounding disconnector, by means of a single rotary control shaft. In particular, it is known to actuate two movable contacts in straight line movement by means of a single rotary shaft.

The document EP 0 735 637 B1 describes, in the embodiment shown in FIG. 8 thereof, a switch apparatus having two busbar disconnectors 25, 35; 29, 36, in which each of the two contacts 35 and 36 that are movable in straight line movement is connected through a generally straight coupling lever 42, 43 to a lever 45 having a single arm. That lever 45 is itself fastened to a rotary shaft 21, the axis of rotation of which is located at the intersection of the respective axes of the straight line movements of the contacts 35 and 36.

The document EP 1 082 791 B1 also describes, in the embodiment shown in FIG. 2 thereof, a switching apparatus that includes a busbar disconnector 53, 31 and a grounding disconnector 55, 16 in which the two contacts 53 and 55 that are movable in straight line movement are connected, each through a coupling rod or lever 74, 75, generally straight in form, to a lever 71 with a single arm. That lever 71 is itself fastened to a rotary shaft 7, the axis of rotation of which is spaced away by a distance a1, a2 from the respective axes of the straight line movement of the contacts 53 and 55.

The document EP 1 068 659 B1 describes, in the embodiment shown in FIG. 2 thereof, a switch apparatus having two interrupters 25, 22, 23; 24, 22, 23 in which a single contact 22 movable in straight line movement is connected, through a pin 26 disposed in the contact 22, to a lever 61 with a single arm. The lever 61 is itself fastened to a rotatable shaft 5, the axis of rotation of which is spaced away from the axes of the straight line movement of the movable contact 22. The transmission ratio (that is to say the ratio between the linear stroke of the movable contact 22 and the sweep angle through which the rotatable shaft 5 turns), and the parallelogram of the forces are not optimized in proximity to the closing positions (that is to say the position of mutual engagement of the movable contact 22 with the corresponding stationary contact 23 or with the stationary contact 24). Such a high ratio makes it necessary to exert a high torque for rotation of the shaft 5. In addition, a radial force reacts on the movable contact 22 in proximity to the closed positions, with the risk that the movable contact will pivot.

The structures of the switch apparatuses taught in the above-mentioned documents all have the serious disadvantage that they are very bulky for the two functions of grounding disconnection and of busbar disconnection.

In addition, the structures of these known apparatuses are not optimal for use at very high voltages, because the dielectric strength of the transmission elements (i.e. the shaft, levers and connecting rod) is hard to achieve.

Finally, the cost of these known switch apparatuses is high.

The size, cost and assembly of switch apparatuses having two interrupters, such as those that have been proposed up to the present time, can be further improved.

The object of the invention is accordingly to propose an improvement in the switching apparatuses in that sense.

SUMMARY OF THE INVENTION

To that end, the invention provides a control mechanism for an electrical switch apparatus having two interrupters, for example a grounding disconnector and a busbar disconnector, each of which comprises a pair of contacts that consist of a stationary switch contact and a movable switch contact that is movable in straight line movement whereby the switch contacts separate from each other during a switching operation, wherein the control mechanism includes a common actuator means for actuating the movable contacts so as to permit one of the interrupters to open while keeping the other interrupter closed and vice versa, and wherein the geometry, dimensions and arrangements of the movable contacts and their actuator means are such as to permit crossing of the straight line strokes of the movable contacts.

The expression "crossing of the straight line strokes" is to be understood to mean, here and in the context of the invention generally, that when viewed in a direction that corresponds to the direction of the axis of rotation, the movable contacts perform overlapping, or in other words, straddling, straight line strokes.

Thus, by means of the overlapping of the displacements of the movable contacts, it is possible to reduce the distances going from the current input to the stationary contacts of each of the two interrupters such as the busbar disconnector or grounding disconnector. The overall size of a switch apparatus in the plane in which movement takes place in the two interrupters of the invention is therefore reduced as compared with the apparatus of the prior art.

In addition, as the overall size is reduced, the cost of such apparatus is also reduced. In that regard the dimensions of the metal casing in which a switch apparatus of the invention is housed are also reduced, and this therefore reduces material, transport and other costs.

In one advantageous embodiment of the invention, the common actuator means comprises:

a rotatable shaft; and a member fastened to the rotatable shaft and consisting of two distinct levers, one of which is U-shaped;

said mechanism includes two pairs of levers that are articulated together, one of the levers in each pair being one of said distinct levers of said member fastened to the rotatable shaft, and the other one of the levers of each pair being articulated to one of the movable contacts; the dimensions of the levers and their arrangement, and the arrangement of the rotatable shaft, being such that the U-shaped lever surrounds the movable contact to which it is coupled over at least part of its straight line stroke.

In a preferred version of that embodiment, the movable contact, such as the movable contact of the busbar disconnector, that is coupled to the U-shaped lever, is in the form of a hollow tube, and the other lever, which is articulated to said hollow tube and to the U-shaped lever, is of elongate shape, the articulation of the elongate lever to the hollow tube being arranged inside the hollow tube at a height sufficient to permit part of the length of said elongate lever to be lodged therein over the course of the straight line stroke of the hollow tube.

In one advantageous variant, the hollow tube has a slot formed on a part of its height that extends from the end thereof opposite to the end that faces the associated stationary switch contact, said slot being arranged to permit the elongate lever to insert itself therein during the straight line movement of the hollow tube, and to increase the length of the straight line stroke from its open position to its closed position.

In another advantageous variant, the hollow tube has a slot formed on a part of its height that extends from the end thereof opposite to the end that faces the associated stationary switch contact, said slot being arranged to permit the elongate lever to insert itself therein during the straight line movement of the hollow tube, and to increase the length of the straight line stroke of the other movable contact from its open position to its closed position.

In a preferred version:

the other one of the levers of said member fastened to the rotatable shaft is of straight shape; and the movable contact, such as the movable contact of the grounding disconnector, that is coupled to the straight lever is in the form of a solid rod.

Thus by, as it were, superimposing a hollow tube on a solid rod of reduced dimensions, the overall size of the apparatus in the direction of the axis of rotation is reduced as compared with an apparatus having two movable contacts in the form of hollow tubes.

In this last mentioned preferred variant, the lever that is articulated between the straight lever fastened to the rotatable shaft and the solid rod is of curved shape such as to enable radial forces on said rod to be reduced in proximity to its closed position.

In the same preferred variant, the solid rod has a slot formed on a part of its height that extends from the end thereof opposite to the end that faces the associated stationary switch contact, said slot being arranged to permit the curved lever to insert itself therein during the straight line movement of said rod, and to increase the length of the straight line movement from its open position to its closed position, and at the same time the amount of the straight line movement of the hollow tube.

In a further embodiment of the mechanism of the invention:

one of the movable contacts, such as the movable contact of the busbar disconnector, is in the form of a hollow tube;

the other one of the movable contacts, such as the movable contact of the grounding disconnector, is in the form of a solid rod;

the common actuator means include a rotatable shaft; and the mechanism has two actuating assemblies, each adapted to convert the rotary movement of the shaft into straight line movement of one of the movable contacts, each said assembly comprising an actuating member fastened to said rotatable shaft, the two actuating assemblies being arranged in parallel with each other in such a way that, when the movable solid rod and hollow tube are in an intermediate position between their closed position and their open position, they are immediately adjacent to each other, being spaced apart by a distance e sufficient to permit frictionless straight line relative movement as between the solid rod and hollow tube.

By leaving a large enough distance between the two actuating assemblies, for the sole purpose of enabling the solid rod and hollow tube to move without any friction between them, a reduced overall size is preserved in the plane orthogonal to the interrupters and along the axis of rotation.

In yet another version, at least one of the two actuating assemblies consists of a pair of levers, one of which is an actuating lever fastened to the rotatable shaft, the other being articulated to one of the movable contacts and to said actuating lever.

In a still further version, one of the two actuating assemblies, such as that for the busbar disconnector movable contact, consists of a disk cam fastened to the rotatable shaft and a pair of levers, one of said levers having one end articulated to a stationary pivot point, while the other end of the same lever is articulated to the other lever of said pair, which is itself articulated to one of the movable contacts, the lever articulated at a stationary pivot point having a spigot located between its two ends and engaged in a cam groove that is formed in the cam, so that the spigot constitutes a cam follower, and wherein the geometry, the length and arrangement of said pair of levers, and the cam groove profile, are such that an additional drive ratio exists between the disk cam and the associated movable contact. The expression "an additional drive ratio between the disk cam (or cams) and the associated movable contact" is to be understood to mean, here and in the context of the invention generally, a drive ratio that is additional to a drive in accordance with which the movable contact is articulated directly to a cam groove in the cam disk, such as is shown for example in the document CH 696 476.

The invention further provides electrical switch apparatus comprising a casing in which the movable contacts of two interrupters, such as a busbar disconnector and a grounding disconnector are at least partially mounted, and further comprising a control mechanism as set forth above.

This apparatus may comprise a guide tube for guiding one of the movable contacts over part of its stroke in straight line movement.

The movable contact guided by said guide tube may with advantage be the grounding rod.

Finally, the invention provides a medium and high voltage gas insulated switch (GIS) having a metal casing and comprising, for at least one phase, a switch apparatus as set forth above.

A medium and high voltage gas insulated switch (with a metal casing) in accordance with the invention preferably has, for each phase, the switching casing of a switch apparatus as set forth above, which is mounted in its own metal casing.

The switch of the invention may thus have the three metal casings coupled together by a linkage system adapted to be displaced in straight line movement by an actuator, and adapted to set simultaneously in rotation the control mechanisms of said apparatus.

BRIEF DESCRIPTION OF THE DRAWINGS

The features and advantages of the invention can be understood more clearly on a reading of the following detailed description, which is given by way of example only and with reference to the accompanying drawings. In the drawings.

DETAILED DESCRIPTION OF PARTICULAR EMBODIMENTS

The drawings described below show a switch apparatus A, constructed in accordance with this invention, that effects switching of one pole. It goes without saying that the arrangement described below for a switch apparatus can be repeated for each pole of a multi-polar combination.

Figure 1:
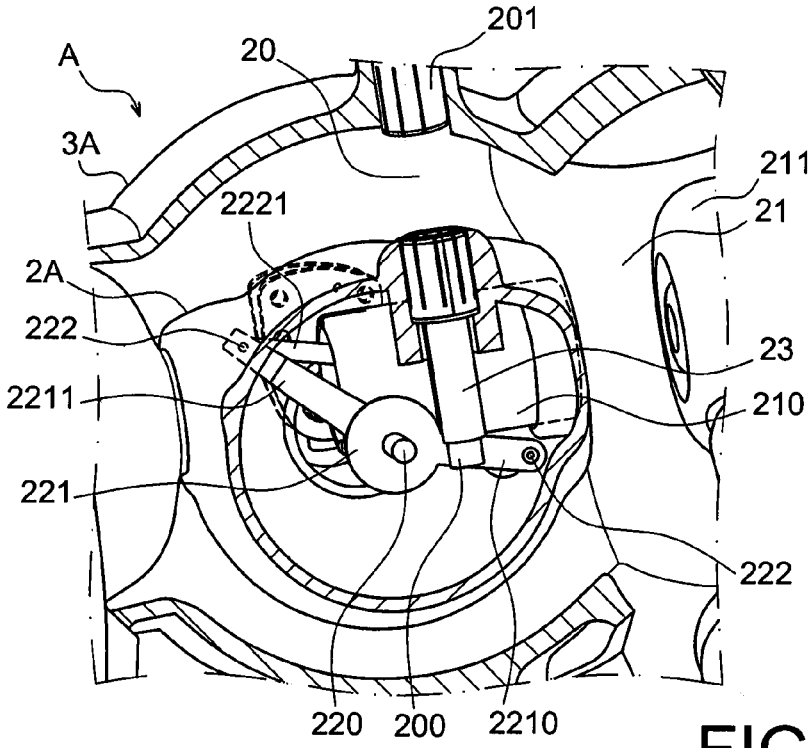
FIG. 1 is a perspective view of part of a gas insulated switch (GIS), with one of the switch apparatuses, which constitutes one of the phases (2A) in one embodiment of the invention, being shown cut away, the apparatus being shown in an intermediate position (or state), in which the busbar disconnector and the grounding disconnector are open.

FIG. 1 shows part of a three-phase switch (switchgear unit) 1, having three identical switch casings. Only one switch casing, 2A, is shown. A switch apparatus constructed in accordance with the invention is contained inside this switch casing. Each of the three identical phases is arranged in its own metal casing. The only one of these casings shown here is the casing 3A containing the corresponding casing 2A.

Figure 2:
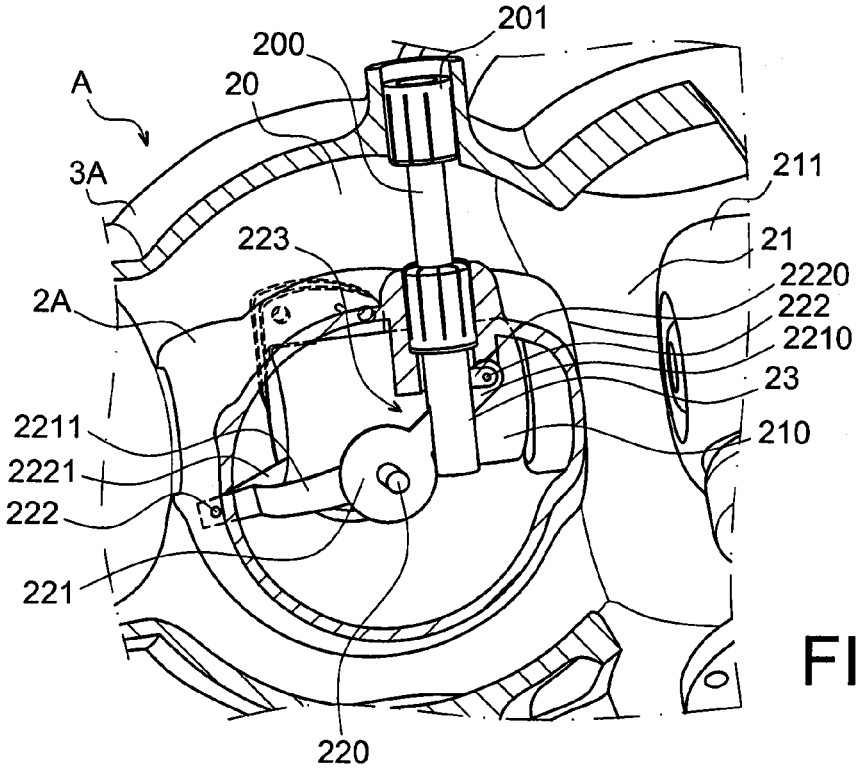
FIG. 2 is another partly cutaway view of the same apparatus as in FIG. 1, with the apparatus being here in a grounding position, with the grounding disconnector closed.
Figure 3:
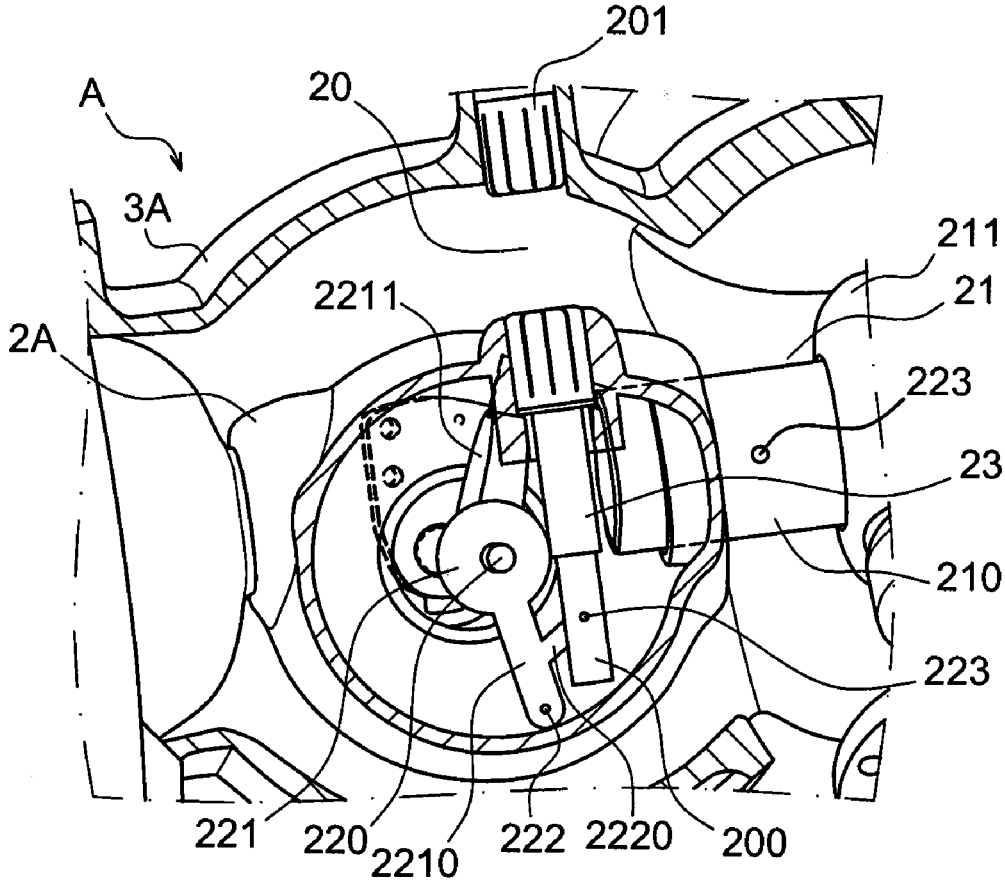
FIG. 3 is a further partly cutaway view of the same apparatus as in FIG. 1, with the apparatus here being shown in a closed position, with the busbar disconnector closed.

In the embodiment shown in FIGS. 1 to 3, the grounding disconnector 20 and the busbar disconnector 21 of the phase 2A are disposed substantially in one plane, being superimposed, or in other words offset along the axis of rotation X. The disconnectors 20 and 21 define an angle of 90° between them. It goes without saying that the relative arrangements of the grounding disconnector 20 and the busbar disconnector 21 can be different, and may be such that the disconnectors define an angle between them in the range between 70° and 180°.

The movable contacts 200 and 210 of one phase, and the actuator means (or drive means) 22, otherwise referred to as force transmission means, of any one phase, are disposed in a common switch casing 2A. Each movable contact 200, 210 slides in an aperture 200A, 210A respectively, formed for that purpose in the casing 2A. The stationary contact 201 of each grounding disconnector is fastened to the inside of the metal casing 3A. The stationary contact 211 of each busbar disconnector is fastened to a conductor that is not shown.

In the embodiment shown, the common actuator means 22 for the movable contacts 200 and 210 effect opening of the grounding disconnector 20 while holding the busbar disconnector closed, and vice versa. The fact that the movable contacts 200 and 210 are not displaced into their open position enables a space saving to be gained for the casing 2A, 2B or 2C.

The common actuator means 22 in the embodiment shown include a shaft 220. This shaft 220 is adapted to be set in rotation by an actuator (not shown), which sets in straight line movement a linkage system that is itself coupled transversely to the three shafts 220 of the phases of the gas insulated switch (GIS) provided by the invention.

In conformity with the invention, the geometry, dimensions and arrangement of the movable contacts 200 and 210, and those of their actuator means, to be described below, enable an increase to take place in the straight line strokes C1, C2 of the movable contacts 200 and 210.

Figure 4:
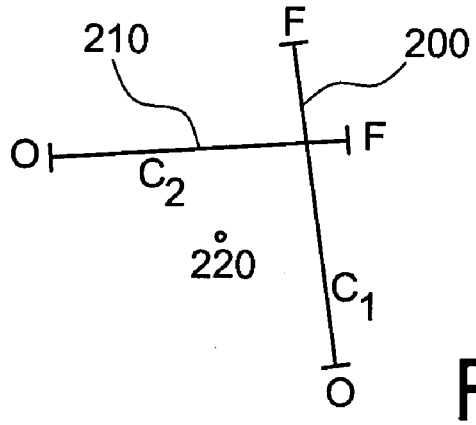
FIG. 4 is a diagram showing some positions in the straight line movement of the movable contacts of the apparatus seen in FIGS. 1 to 3.

FIG. 4 shows diagrammatically, on a common plane transverse to the axis of rotation 220, the positions at the ends of the strokes of the movable contacts 200 and 210, corresponding respectively to their open and closed positions. More precisely, the axis of the stroke (straight line movement) for each movable contact 200 or 210 is its axis of symmetry, the indication O corresponding to the open position and the indication F corresponding to the closed position, the stroke of the movable contact 200 of the grounding disconnector 20 is indicated at C1 and the stroke of the contact 210 of the busbar disconnector 21 being indicated at C2. The positions O and F are those taken by the end of each of the movable contacts 200 and 210 opposite to the end that faces towards the corresponding stationary contact 201 or 211.

It is clear from a study of FIG. 4 that the control mechanism of this invention enables the strokes C1 and C2 of the respective movable contacts 200 and 210 of the grounding disconnector 20 and busbar disconnector 21 to be crossed.

In the embodiment shown in FIGS. 1 to 3, the common actuator means further include a member 221 having two arms 2210 and 2211, which constitute distinct levers, this member 221 being fastened on the rotatable shaft 220. One of the levers, 2211, is U-shaped. The other lever, 2210, is of straight, elongate shape.

Each of the two levers 2210 and 2211 of the member 221 fastened to the shaft 220 is articulated at a pivot point 222 with a respective connecting rod 2220, 2221, these connecting rods also being coupling levers.

The coupling lever 2220, which is articulated to the lever 2210, is curved so as to reduce the radial forces that are liable to occur on the ground contact 200. The lever 2220 is itself articulated at a pivot point 223 to the movable contact 200 of the grounding disconnector 20.

The coupling lever 2221 that is articulated to the lever 2211 is of straight elongate shape, and is itself articulated at a pivot point 223 to the movable contact 210 of the grounding disconnector 21.

The dimensions of the levers 2211 and 2221, together with their arrangement, and that of the rotatable shaft 220, are so chosen that the U-shaped lever 2211 surrounds the movable contact 210 to which it is coupled over at least part of its stroke C2.

The movable contact 210 for the busbar disconnector 21, coupled to the U-shaped lever 2211, is in the form of a hollow tube (see for example FIG. 2).

The pivot point 223 of the straight lever 2221 to the hollow tube 210 is arranged inside the hollow tube at a height sufficient to enable part of the length of the straight lever 2221 to be lodged therein over the stroke C1 of the hollow tube.

As shown, the movable contact 200 of the grounding disconnector 20, coupled to the straight lever 2210, is in the form of a solid rod.

The lever 2220, articulated between the straight lever 2210 fastened to the rotatable shaft 220 and the solid rod 200, is of curved shape so as to enable the radial forces exerted on the rod in proximity to its closed position to be reduced (see FIG. 2).

In the switch apparatuses shown, a guide tube 23 is also provided, which guides the rod of the grounding contact 200 in its straight line movement over most of its stroke (see for example FIG. 2).

Figure 5A:
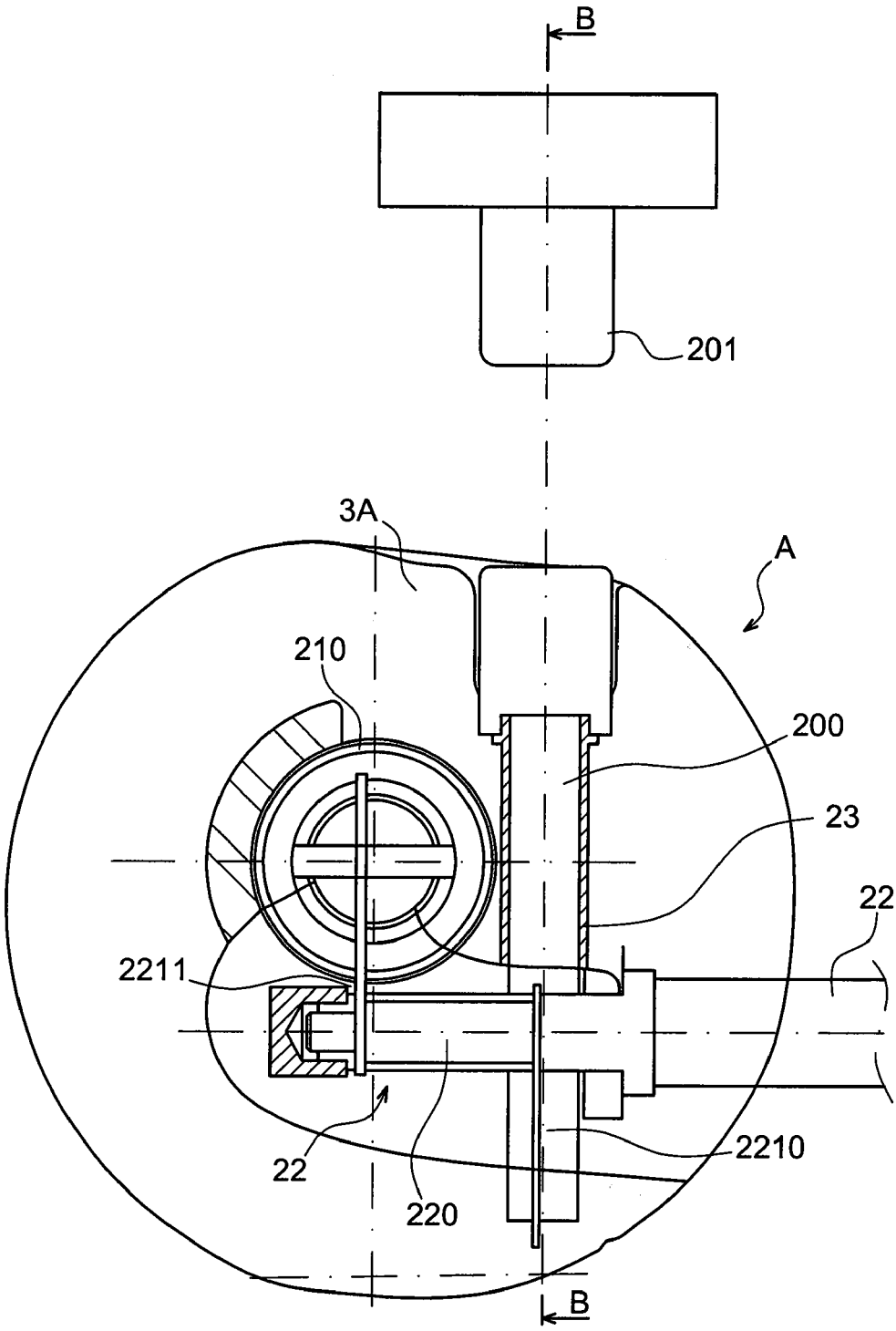
FIGS. 5A and 5B are views in partial cross section of one of the switch apparatuses, which constitutes one of the phases, 2A, in another embodiment of the invention different from that in FIGS. 1 to 3, the apparatus here being shown in an intermediate position with the busbar and grounding disconnectors open.
Figure 5B:
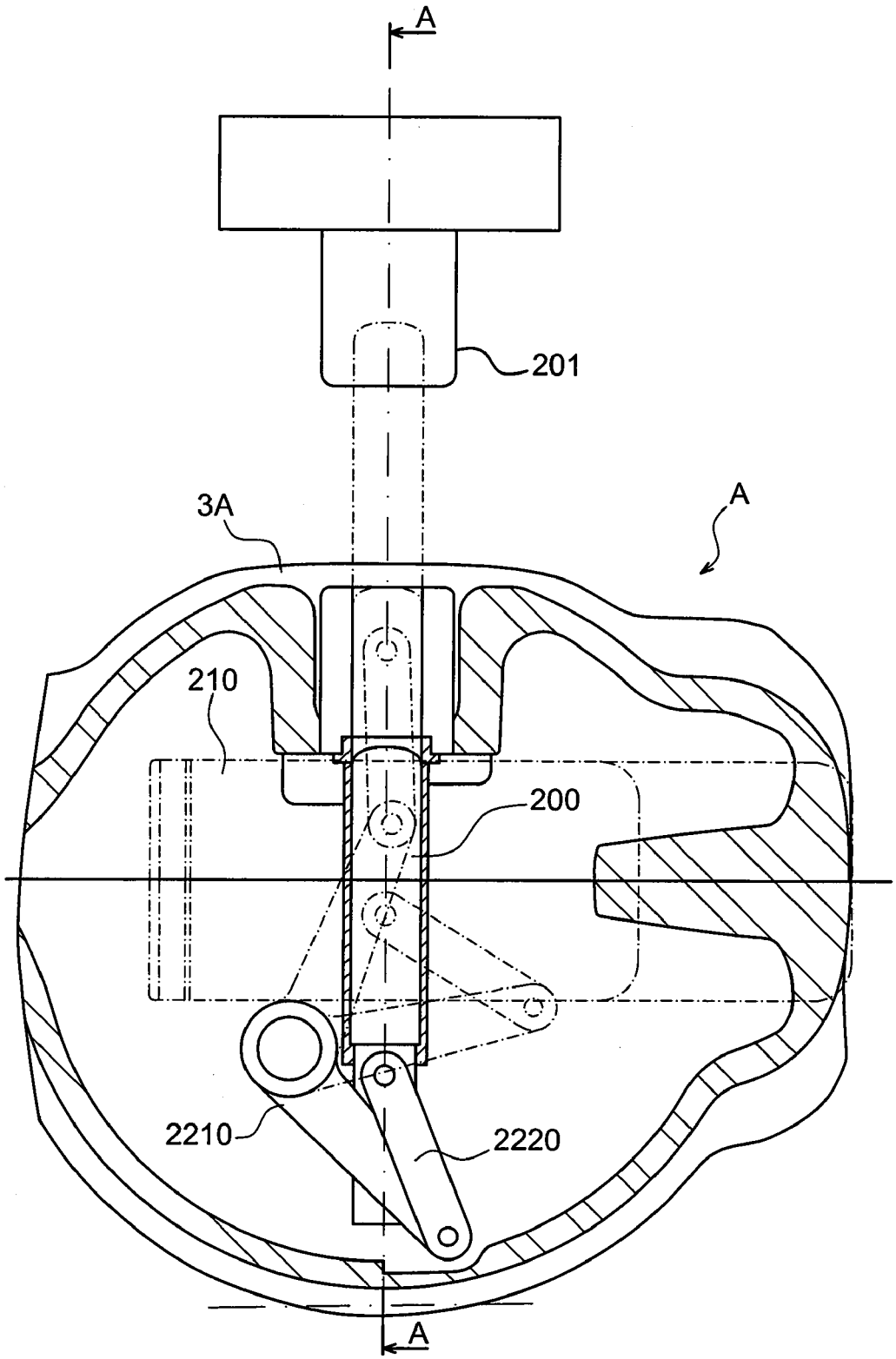
Figure 6:
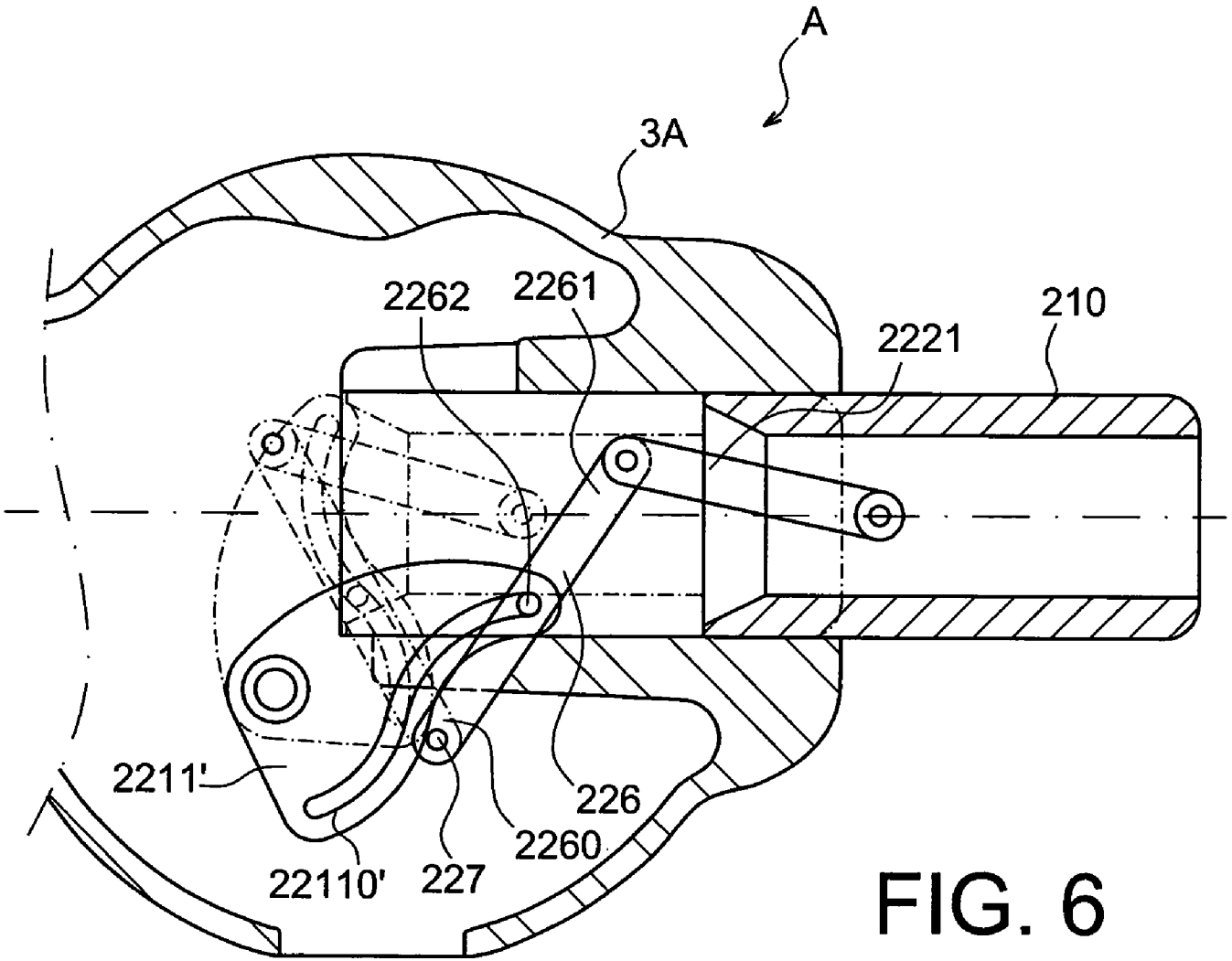
FIG. 6 is a view in partial cross section of an apparatus in the embodiment shown in FIGS. 5A and 5B, and shows a variant of the drive for the movable contact of the busbar disconnector, the movable contact shown being in its closed position.

FIGS. 5A to 6 show a further embodiment of the invention.

In this version, the movable contact 210 of the busbar disconnector 21 is in the form of a hollow tube, while the movable contact 200 of the grounding disconnector 20 is in the form of a solid rod.

The control mechanism then includes two actuating (drive) assemblies, each of which converts the rotary movement of the shaft 220 into straight line movement in one of the movable contacts 200, 210.

Each of these assemblies comprises an actuating member 2210, 2211 fastened to the rotary shaft 220. The two actuating assemblies are arranged in parallel with each other, in such a way that, when the movable contacts 200 and 210 are in an intermediate position between their closed and open positions, they are immediately adjacent to each other, the distance e between them being sufficient to permit their relative movement to occur without any friction.

As is shown in FIG. 5B, the actuating assembly for the movable rod 200 of the grounding disconnector 20 consists of a pair of levers 2210 and 2220. The actuating lever 2210 fastened to the rotary shaft 220 is articulated directly to the other lever 2220, which is itself articulated directly to the movable rod 200.

As is shown in FIG. 6, a variant for the actuation of the movable hollow tube 210 of the busbar disconnector consists of a disk cam 2211' that is fastened to the rotary shaft 220, together with a pair of levers 2221 and 226 that are articulated together. One of the levers, 226, has an end 2260 that is pivoted at a stationary articulation point 227. The other end, 2261, of the lever 226 is articulated to the lever 2221 that is articulated to the movable hollow tube 210. The lever 226, fastened to the point 227, includes a spigot 2262 that is mounted between its two ends 2260 and 2261 and that is engaged in a cam groove 2110' formed in the cam 211', so that the spigot acts as a cam follower.

The three switching positions of the apparatus shown in FIGS. 1 to 6 are as follows:

Position No. 1: grounding disconnector 20 open, busbar disconnector 21 open (see FIGS. 1 and 5A and 5B).

Position No. 2: grounding disconnector 20 closed, busbar disconnector 21 open (see FIG. 2).

Position No. 3: grounding disconnector 20 open, busbar disconnector 21 closed (see FIGS. 3 and 6).

The advantages of the arrangements provided by the invention just described are numerous:

Because of the overlap between the strokes of the movable contacts, the overall size of the switch apparatus of the invention is reduced as compared with switching apparatus of kinds currently known that comprise a busbar disconnector and a grounding disconnector.

The lateral forces applied to the movable contacts in the apparatus of the invention are reduced as compared with those known at the present time.

The switch apparatus of the invention works in total safety and with great reliability.

The invention claimed is:

1. A control mechanism for an electrical switch apparatus having two interrupters, each of which comprises a pair of contacts that consists of a stationary switch contact and a movable switch contact that is movable in straight line movement whereby the switch contacts separate from each other during a switching operation, wherein the control mechanism includes a common actuator means for actuating the movable contacts so as to permit one of the interrupters to open while keeping the other interrupter closed and vice versa, and wherein the geometry, dimensions and arrangement of the movable contacts and their actuator means are such as to permit crossing of the straight line strokes of the movable contacts, and wherein:

the common actuator means comprises:

a rotatable shaft; and a member fastened to the rotatable shaft and consisting of two distinct levers, one of which is U-shaped;

said mechanism includes two pairs of levers that are articulated together, one of the levers in each pair being one of said distinct levers of said member fastened to the rotatable shaft, and the other one of the levers of each pair being articulated to one of the movable contacts;

the dimensions of the levers and their arrangement, and the arrangement of the rotatable shaft, being such that the U-shaped lever surrounds the movable contact, to which it is coupled over at least part of its straight line stroke.

2. A control mechanism for a switch apparatus according to claim 1, wherein:

the movable contact, such as the movable contact of the busbar disconnector, that is coupled to the U-shaped lever, is in the form of a hollow tube; and the other lever, which is articulated to said hollow tube and to the U-shaped lever, is of elongate shape, the articulation of the elongate lever to the hollow tube being arranged inside the hollow tube at a height sufficient to permit part of the length of said elongate lever to be lodged therein over the stroke of the straight line movement of the hollow tube.

3. A control mechanism for a switch apparatus according to claim 2, wherein the hollow tube has a slot formed on a part of its height that extends from the end thereof opposite to the end that faces the associated stationary switch contact, said slot being arranged to permit the elongate lever to insert itself therein during the straight line movement of the hollow tube, and to increase the length of said movement from its open position to its closed position.

4. A control mechanism for a switch apparatus according to claim 2, wherein the hollow tube has a slot formed on a part of its height that extends from the end thereof opposite to the end that faces the associated stationary switch contact, said slot being arranged to permit the elongate lever to insert itself therein during the straight line movement of the hollow tube, and to increase the length of the straight line stroke of the other movable contact from its open position to its closed position.

5. A control mechanism for a switch apparatus according to claim 1, wherein:

the other one of the levers of said member fastened to the rotatable shaft is of straight shape; and the movable contact, such as the movable contact of the grounding disconnector, that is coupled to the straight lever, is in the form of a solid rod.

6. A control mechanism for a switch apparatus according to claim 5, wherein the lever that is articulated between the straight lever fastened to the rotatable shaft and the solid rod is of curved shape such as to enable radial forces on said rod to be reduced in proximity to its closed position.

7. A control mechanism for a switch apparatus according to claim 6, wherein the solid rod has a slot formed on a part of its height that extends from the end thereof opposite to the end that faces the associated stationary switch contact, said slot being arranged to permit the curved lever to insert itself therein during the straight line movement of said rod, and to increase the length of the straight line stroke from its open position to its closed position, and at the same time the amount of the straight line stroke of the hollow tube.

8. Electrical switch apparatus comprising a casing in which the movable contacts of two interrupters, such as a busbar disconnector and a grounding disconnector are at least partially mounted, and further comprising a control mechanism according to claim 1.

9. Electrical switch apparatus according to claim 8, further comprising a guide tube for guiding one of the movable contacts over part of its stroke in straight line movement.

10. Electrical switch apparatus according to claim 9, wherein the movable contact guided by said guide tube is a grounding rod.

11. A medium and high voltage gas insulated switch comprising, for at least one phase, a switch apparatus according to claim 8.

12. A gas insulated switch wherein, for each phase, the casing of the switch apparatus according to claim 8 is mounted in its own metal casing.

13. A gas insulated switch according to claim 12, comprising three metal casings coupled together by a linkage system adapted to be displaced in straight line movement by an actuator, and adapted to set simultaneously in rotation the control mechanisms of said apparatus.

14. The control mechanism of claim 1, wherein the two interrupters comprise a grounding disconnector and a busbar disconnector.

15. A control mechanism for an electrical switch apparatus having two interrupters, each of which comprises a pair of contacts that consists of a stationary switch contact and a movable switch contact that is movable in straight line movement whereby the switch contacts separate from each other during a switching operation, wherein the control mechanism includes a common actuator means for actuating the movable contacts so as to permit one of the interrupters to open while keeping the other interrupter closed and vice versa, and wherein the geometry, dimensions and arrangement of the movable contacts and their actuator means are such as to permit crossing of the straight line strokes of the movable contacts, and wherein:

one of the movable contacts is in the form of a hollow tube;

the other one of the movable contacts is in the form of a solid rod;

the common actuator means include a rotatable shaft; and the mechanism has two actuating assemblies, each adapted to convert the rotary movement of the shaft into straight line movement of one of the movable contacts, each said assembly comprising an actuating member fastened to said rotatable shaft, the two actuating assemblies being arranged in parallel with each other in such a way that, when the movable solid rod and hollow tube are in an intermediate position between their closed position and their open position, they are immediately adjacent to each other, being spaced apart by a distance (e) sufficient to permit frictionless straight line relative movement as between the solid rod and hollow tube.

16. A control mechanism according to claim 15, wherein at least one of the two actuating assemblies consists of a pair of levers, one of which is an actuating lever fastened to the rotatable shaft, the other being articulated to one of the movable contacts and to said actuating lever.

17. A control mechanism according to claim 15, wherein at least one of the two actuating assemblies, such as that for the busbar disconnector movable contact, consists of a disk cam fastened to the rotatable shaft and a pair of levers, one of said levers having one end articulated to a stationary pivot point, while the other end of the same lever is articulated to the other lever of said pair, which is itself articulated to one of the movable contacts, the lever articulated at a stationary pivot point having a spigot located between its two ends and engaged in a cam groove that is formed in the cam, so that the spigot constitutes a cam follower, and wherein the geometry, the length and arrangement of said pair of levers, and the cam groove profile, are such that an additional drive ratio exists between the disk cam and the associated movable contact.

18. The control mechanism of claim 15, wherein the movable contact in the form of a hollow tube is the movable contact of a busbar disconnector, and the movable contact in the form of a solid rod is the movable contact of a grounding disconnector.

19. Electrical switch apparatus comprising a casing in which the movable contacts of two interrupters, such as a busbar disconnector and a grounding disconnector are at least partially mounted, and further comprising a control mechanism according to claim 15.

20. Electrical switch apparatus according to claim 19, further comprising a guide tube for guiding one of the movable contacts over part of its stroke in straight line movement.

21. Electrical switch apparatus according to claim 20, wherein the movable contact guided by said guide tube is a grounding rod.

22. A medium and high voltage gas insulated switch comprising, for at least one phase, a switch apparatus according to claim 19.

23. A gas insulated switch wherein, for each phase, the casing of the switch apparatus according to claim 19 is mounted in its own metal casing.

24. A gas insulated switch according to claim 23, comprising three metal casings coupled together by a linkage system adapted to be displaced in straight line movement by an actuator, and adapted to set simultaneously in rotation the control mechanisms of said apparatus.

* * * * *